United States Patent [19]

Foutz

[11] Patent Number: 4,643,910

[45] Date of Patent: Feb. 17, 1987

[54] PROCESS FOR CURING POLYIMIDE

[75] Inventor: Eugene L. Foutz, Scottsdale, Ariz.

[73] Assignee: Motorola Inc., Schaumburg, Ill.

[21] Appl. No.: 718,253

[22] Filed: Apr. 1, 1985

[51] Int. Cl.[4] ..... B05D 3/02

[52] U.S. Cl. ..... 427/10; 427/8; 427/79; 427/379; 427/385.5

[58] Field of Search ..... 427/385.5, 379, 79, 427/8, 10

[56] References Cited

U.S. PATENT DOCUMENTS

| | | | |
|---|---|---|---|
| 3,729,814 | 5/1973 | Wright et al. | 427/79 |
| 4,468,411 | 8/1984 | Sloan et al. | 427/8 |
| 4,469,713 | 9/1984 | Schwiecker et al. | 427/8 X |
| 4,522,880 | 6/1985 | Klostermeier et al. | 427/385.5 X |
| 4,530,851 | 7/1985 | Shannon et al. | 427/8 X |

OTHER PUBLICATIONS

A. M. Wilson, Thin Solid Films, 83 (1981), 145–163.

*Primary Examiner*—Thurman K. Page

*Attorney, Agent, or Firm*—John A. Fisher; Raymond J. Warren

[57] ABSTRACT

A process is disclosed for the complete curing of a layer of polyimide in a short time at a low temperature. A solution of polyimide or polyimide precursor having a well-defined viscosity is applied to a substrate to form a layer of predetermined thickness. The substrate and layer are heated in such a manner to cause a continuous increase in temperature of the layer at a predetermined rate to a temperature between about 170° C. and about 225° C. By maintaining a continuous temperature rise during this heating, the total curing of the polyimide layer is accomplished at a temperature less than about 225° C. To determine the optimum rate of temperature rise to cure a given polyimide layer, a similar polyimide layer is formed as a dielectric layer on a ceramic substrate having interdigitated capacitor electrodes formed thereon. The dielectric dissipation factor of the polyimide material is measured dynamically during the curing process. The optimum rate for curing is that rate which causes the dielectric dissipation factor to rapidly drop to near zero without deleterious effects in the polyimide layer.

2 Claims, 4 Drawing Figures

PROCESS FOR CURING POLYIMIDE

BACKGROUND OF THE INVENTION

This invention relates generally to a process for curing a polyimide layer, and more specifically to a process for the rapid, low temperature curing of polyimide layers and to a process for monitoring that curing.

Polyimides have become very widely used materials in applications requiring a protective coating, insulating layer, or the like. For example, in the semiconductor industry, polyimide coatings are used for arc suppression, dielectric passivation, interlayer isolation, planarization, mechanical protection and support, and the like. High voltage transistors are covered with thick polyimide layers for arc suppression so that the inherently high voltage operation of the device can be achieved. Thick layers of polyimide are also used for alpha particle protection of sensitive MOS integrated circuits with the polyimide layer acting as an alpha particle absorber. Such thick layers, applied after device fabrication is completed, also serve as a mechanical protection layer and as a support for wires connecting the semiconductor die to the die package. Thinner layers of polyimide are used to isolate metal layers in an integrated circuit using multiple layers of metallization. Thin polyimide layers are also used as a final passivation layer on integrated circuits, and to planarize irregular surfaces in integrated circuit fabrication. Other uses of polyimide include insulation on transformer wire, and insulation and isolation on printed circuit boards.

In each application the polyimide is applied as a liquid and must subsequently be cured. The material applied may be a polyimide, a partially imidized material, or a polyimide precursor such as a polyamic acid. Hereafter such materials will be referred to generically as polyimides. The viscosity of the liquid applied and the method of application generally determine the thickness of the resulting layer. To achieve the final cured state, which is a fully imidized state, the material must be heat treated to allow the material to become fully cross-linked. Suppliers of the polyimide material suggest that the material be cured in a series of steps with each step being at a higher temperature than the last. While the exact cure cycle differs slightly from manufacturer to manufacturer, a typical cycle includes about 30 minutes at 135° C., one hour at 300° C., and then 10 minutes at about 400° C. In some applications, however, 400° C., and often even 300° C., is high enough to degrade or even destroy the device or other substrate to which the polyimide is being applied. For example, some solders used in assembling transistors or devices on a printed circuit board melt as low as about 270° C. The standard, advertised curing cycles thus are too high in temperature to permit the use of polyimides in many applications.

The polyimide must be fully cured to be fully effective in its intended use. Partially cured polyimide, for example, is less resistant to etching in certain etchants than is fully cured polyimide. Also, partially cured polyimide is more susceptible to the absorption of water which can lead to long term reliability problems. Further, the partially cured polyimide is less stable than is the fully cured polyimide, and this can lead to other reliability problems.

Unfortunately, there has not been a good way in which to measure polyimide films to determine that they are fully cured. It is conventional to associate degree of cure with the dielectric dissipation factor of the polyimide material. A fully cured layer has a near zero dissipation factor. Numerically, a fully cured layer has a dissipation factor less than about 0.001. The usual way to measure dissipation factor is to apply the polyimide to a metallized glass slide. After curing the polyimide, a second metal electrode is applied to the top of the polyimide and the dissipation factor of the resulting parallel plate capacitor is measured. If it is determined that the curing is not complete, another sample is made up in the same manner, the cure cycle is adjusted, and the dissipation of the new capacitor is measured. In this way, approximate cure cycles are derived. The cure cycle is only approximate since the test capacitor may not be a good approximation of the actual application. In addition, the procedure is very laborious, so that, in practice, it is not often used.

In view of the widespread potential applications for polyimides, the need to cure those polyimides at relatively low temperatures, the need to effect a complete cure of the polyimide, and the need to realistically monitor the cure cycle, it is therefore an object of this invention to provide an improved process for curing a polyimide layer.

It is another object of this invention to provide an improved low temperature polyimide curing process.

It is a still further object of this invention to provide an improved process for monitoring the curing of a polyimide layer on a realistic test structure.

It is yet another object of this invention to provide an improved process for fabricating semiconductor devices.

BRIEF SUMMARY OF THE INVENTION

The foregoing and other objects and advantages of the invention are achieved through a process in which a polyimide layer is subjected to a continuous increase in temperature at a predetermined rate up to a final cure temperature. In one embodiment of the invention, a polyimide or polyimide precursor is applied to a substrate from a solution of given viscosity to form a layer of predetermined thickness. The substrate and layer are heated to cause a continuous increase in temperature at a predetermined rate up to a previously determined cure temperature. After reaching this cure temperature the curing is complete and the heating is terminated. In accordance with a preferred embodiment, the rate of temperature rise and the final cure temperature are determined by a similar application of the polyimide or polyimide precursor to an interdigitated capacitor electrode structure formed on a substrate which approximates the thermal behavior of the primary substrate. Dielectric dissipation of the polyimide material is measured by contacting the capacitor electrodes while the polyimide is being cured. Optimum cure conditions are achieved by dynamically monitoring the dissipation factor while the polyimide is curing.

DETAILED DESCRIPTION OF PREFERRED EMBODIMENTS

Figure 2:
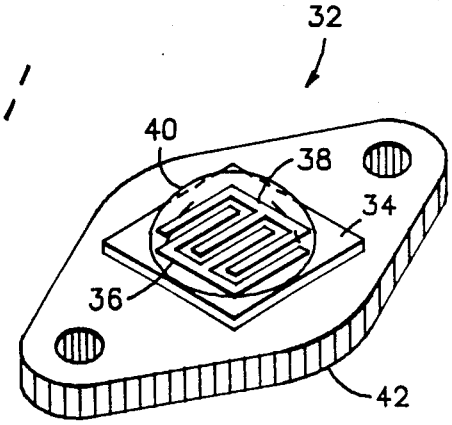
FIG. 2 illustrates a capacitor structure used to monitor curing of a polyimide layer.

FIG. 2 illustrates a power transistor 10 which utilizes a layer of polyimide 12 for arc suppression, mechanical protection, and lead support. A power transistor die 14, such as a high voltage bipolar transistor, is mounted on a metal header 16, here illustrated to be of the TO-3 type. Base and emitter bonding pads 18, 20, respectively, on the transistor die are connected to header leads 22, 24 by leads 26, 28. Leads 22, 24 pass through the header 16 and are isolated from the header by glass seals 30. A metal cover (not shown in this view) covers and protects the die and leads. Die 14 is attached to header 16 by a solder which is often one of the low melting point lead/tin solders.

In operation of the device, very high voltages may be applied between the terminals of the device. Without any protection, the voltage to which the device can be operated may be limited by arcing between the leads, either in the air separating the leads or along the surface of the device. By applying an arc suppressant covering to the die and the surrounding leads, arcs are suppressed and the inherent breakdown voltage of the device itself can be achieved. Polyimide coating 12 serves as an arc suppressant and allows the device to be operated at high voltages. In addition, the polyimide surrounds at least the ends of wires 26, 28, supporting those wires, and thereby improving the mechanical stability of the device. The polyimide also provides physical protection to the sensitive die, protecting the die from contaminants, abrasive particles, scratches, and the like.

The polyimide is applied to the transistor by dropping a solution of polyimide or polyimide precursor from an applicator onto the die. The thickness of the layer of material applied is dependent primarily upon the viscosity of the solution applied and the method of application. In this application, the polyimide solution is applied in a layer having a thickness of about 75–100 microns. To be fully effective in its intended role, the polyimide must be cured by the application of heat. Because of the presence of a low melting point solder as well as the desire to avoid high temperatures which may be deleterious to the properties of the transistor, the maximum curing temperature must be limited.

FIG. 2 illustrates a structure useful for monitoring the curing of a polyimide layer and for determining the optimum process for effecting such curing. Structure 32 includes an insulating substrate 34 such as a sheet of ceramic material. Disposed on the surface of the insulating material are two interdigitated electrodes 36, 38. The two electrodes form two plates of a capacitor. The use of an interdigitated structure increases the capacitance between the two electrodes to a value which is readily measurable. A layer of polyimide material 40 is applied over the capacitor electrode structure in the same manner as polyimide is applied to a device structure. The polyimide layer on structure 32 will thus be very similar to the polyimide layer formed on an actual device. In order to closely approximate the actual thermal environment experienced by a polyimide layer on an actual device, ceramic substrate 34 is mounted on a TO-3 header 42. For other applications, other appropriate mounting bases should be used. Electrical contacts (not shown in this view) are made to electrodes 36 and 38 and these electrodes are coupled to an instrument for measuring dielectric dissipation factor. Polyimide layer 42 is then heated by placing the structure on a hot plate, belt furnace, convection oven, IR oven, or the like. The heating causes the curing of the polyimide layer and the curing is monitored by measuring the dielectric dissipation factor as the curing proceeds. This structure thus allows the real time monitoring of the curing process.

Figure 3:
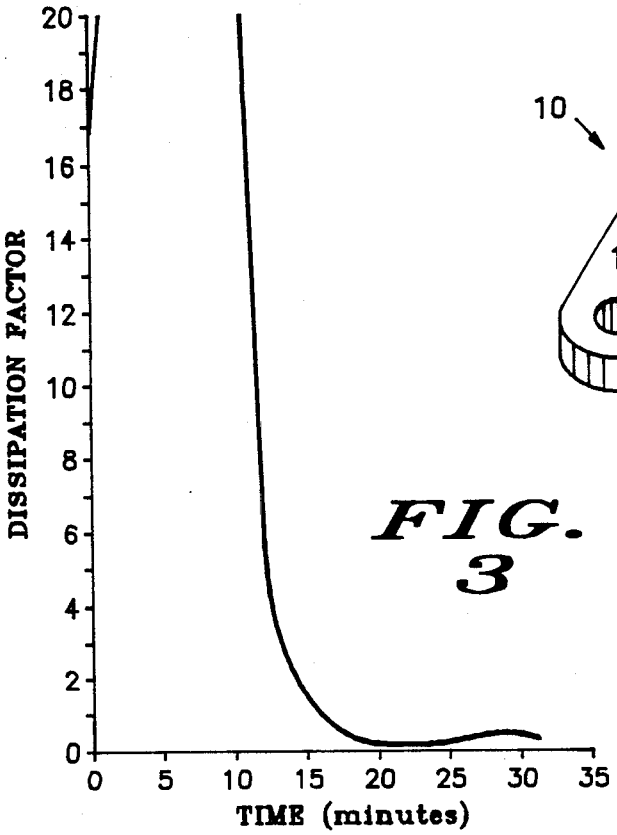
FIG. 3 illustrates dielectric dissipation factor as a function of curing time for a particular cure cycle.
Figure 1:
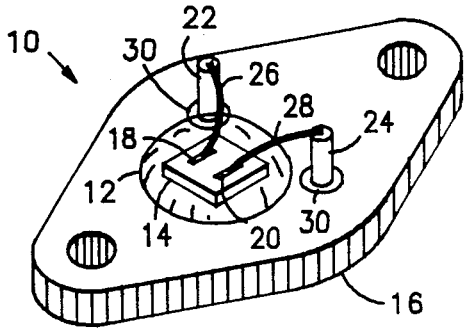
FIG. 1 illustrates a semiconductor device processed in accordance with the invention.

FIG. 3 illustrates a typical curve of dissipation factor as a function of time, measured on a structure as described above. The structure included a polyimide material PI 2555 obtained from DuPont. The structure was heated so that the temperature increased continuously at a rate of about 9.5° C. per minute. The dissipation factor was found to initially increase, go off scale, and then decrease rapidly before the rate of change of dissipation factor decreased as the dissipation factor itself approached zero. The polyimide was determined to be fully cured after about 20 minutes, or after the temperature had been increased continuously to about 200° C. In this context a fully cured polyimide layer is one in which the dielectric dissipation factor is measured to be less than about 0.001. The dissipation factor can be monitored, for example, on a Hewlett Packard LCR meter model 4262A.

Figure 4:
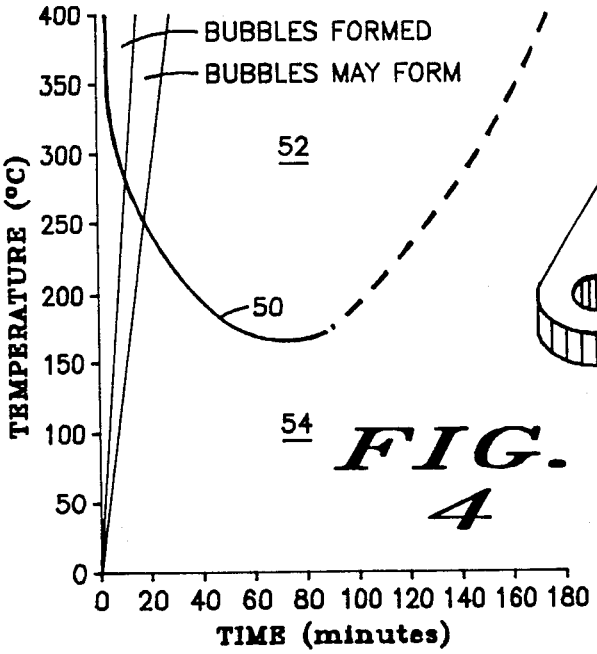
FIG. 4 illustrates an optimized curing curve for a specific type of polyimide.

FIG. 4 illustrates the results derived from a series of experiments conducted using a test structure similar to that described above. As a result of these experiments the time and minimum temperature requirements for achieving a fully imidized film have been determined. In achieving a fully imidized film at a low temperature it is important that the film be subjected to heating which constantly raises the temperature without allowing the film to either stabilize at a single temperature or decline in temperature. Although the applicant does not wish to be bound by his theory, it is believed that for the lowest temperature curing the heat must be supplied at a rate approximately equal to the rate at which the chemical reaction is taking place within the polyimide material. If the heat is applied at too high a rate, the final cure temperature will be higher than the optimum temperature and deleterious bubbles may form in the polyimide. If the rate of temperature rise is too slow, the chemical reaction will stop or slow before the polyimide is fully cured and the final cure temperature must be increased significantly. It is believed that this may be what is happening in the standard step cure method.

As indicated in FIG. 4, which plots polyimide temperature as a function of the time necessary to reach that temperature, a bounding line 50 divides the fully imidized 52 from the partially imidized 54 regime. Because of the danger of bubble formation, the rate of temperature rise should be limited to less than or equal to about 14° C. per minute, and preferably to less than or equal to about 10° C. per minute. For practical considerations of providing a production compatible process, the rate of temperature rise should be greater than about 2.5° C. per minute to avoid having unduly long cure cycles. In addition, curing the polyimide at a lower rate results in the polyimide not being fully cured or requires additional heat treatment at much higher temperatures to achieve full imidization.

In a preferred embodiment of the invention the solution of polyimide or polyimide precursor is heated to cause a continuous increase in the polyimide temperature at a rate between about 2.5° C. per minute and about 10° C. per minute up to a temperature of about 170°–225° C. Further increases in temperature do not degrade the polyimide layer, but also do not serve the increase the amount of imidization. After reaching the final cure temperature,heat is removed and the device is allowed to cool back to room temperature.

In a further embodiment of the invention, the final cured state can be achieved more rapidly by heating the polyimide material to cause a continuous increase in temperature at a rate between about 2.5° C. per minute and about 10° C. per minute up to a temperature of about 170° C. This is followed by increasing the rate of temperature increase to 20°-30° C. per minute until the temperature arises to about 225° C. During the curing the temperature must not be allowed to either stabilize at a single temperature or decrease until the final cure temperature is achieved.

Thus it is apparent that there has been provided, in accordance with the invention, an improved process for curing polyimide films and for monitoring the curing of the films which fully meets the objects and advantages set forth above. Although the invention has been described and illustrated with reference to specific embodiments thereof, it is not intended that the invention be limited to these illustrative embodiments. The data presented above, for example, is representative of a wide range of polyimide materials which are commercially available. Changes in the optimum rate of temperature rise may be necessary for certain polyimide materials, very thin layers of polyimide material, and very dilute solutions of polyimide material. Such changes in optimum rate of temperature increase can be determined, however, by using a test structure as described above. The process for curing polyimide layers can be applied to polyimide layers provided on a wide variety of substrates and applications. In some of these applications the polyimide solution will be applied by a drip applicator, spin applicator, or the like. The curing process is not changed by either the substrate to which the material is applied or by the manner in which it is applied. Other variations and modifications will be obvious to those skilled in the art after consideration of the foregoing detailed description. Accordingly, it is intended to encompass within the invention all such variations and modifications as fall within the scope of the appended claims.

I claim:

1. A process for curing a polyimide layer which comprises the steps of: applying a polyimide or polyimide precursor to a substrate to form a layer of predetermined thickness; heating said substrate and said layer to cause a continuous increase in temperature of said layer at a predetermined rate to a temperature between about 170 degrees Celsius and about 225 degrees Celsius, wherein said predetermined rate is selected by measuring dissipation of a capacitor dielectric, said capacitor dielectric formed by applying said polyimide or said polyimide precursor to a surface having capacitor electrodes thereon to form a layer of said predetermined thickness, said predetermined rate being a rate at which dissipation measured between said electrodes declines to zero or near zero; and then terminating said heating.

2. The process of claim 1 wherein said capacitor electrodes comprise a pattern of interdigitated fingers.

* * * * *